United States Patent [19]

Mizuno et al.

[11] 4,362,529

[45] Dec. 7, 1982

[54] HEAT TRANSFER PRINTING SHEET AND HEAT TRANSFER PRINTING METHOD USING THE SAME

[75] Inventors: Shogo Mizuno, Toride; Sumio Ishii, Inaki, both of Japan

[73] Assignee: Dai Nippon Printing Co., Ltd., Tokyo, Japan

[21] Appl. No.: 920,683

[22] Filed: Jun. 30, 1978

Related U.S. Application Data

[63] Continuation of Ser. No. 671,066, Mar. 29, 1976, abandoned, which is a continuation of Ser. No. 452,658, Mar. 19, 1974, abandoned.

[30] Foreign Application Priority Data

Mar. 20, 1973 [JP] Japan ..... 48-31440

[51] Int. Cl.[3] ..... D06D 3/70

[52] U.S. Cl. ..... 8/471

[58] Field of Search ..... 8/2.5 A, 471

[56] References Cited

U.S. PATENT DOCUMENTS 3,969,071 7/1976 Hugelin ..... 8/2.5R

FOREIGN PATENT DOCUMENTS 50-06884 1/1975 Japan .

OTHER PUBLICATIONS

Fairchild's Dictionary of Textiles (Fairchild Publications, New York), 1975, pp. 556–557.

*Primary Examiner*—A. Lionel Clingman

*Attorney, Agent, or Firm*—Birch, Stewart, Kolasch & Birch

[57] ABSTRACT

Heat transfer printing sheet wherein a pattern comprising a basic dye having a poor heat transferable property, an alkaline agent having the property of increasing the heat transferable property of the basic dye and a binder is formed on a base support sheet and also a resin film through which the basic dye can be passed when the heat transfer printing is carried out, but can not be passed through when the heat transfer printing is not carried out is formed on the pattern. The resin film can be provided on the right and/or back side surfaces of the base support sheet. Heat transfer printing method using the above heat transfer printing sheet with heat under pressure.

25 Claims, 6 Drawing Figures

HEAT TRANSFER PRINTING SHEET AND HEAT TRANSFER PRINTING METHOD USING THE SAME

This application is a continuation, of copending application Ser. No. 671,066, abandoned filed on Mar. 29, 1976, which is a continuation of pending prior application Ser. No. 452,658 filed on Mar. 19, 1974 abandoned.

The present invention relates to a heat transfer printing sheet and heat transfer printing method using the same, and more particularly relates to a heat transfer printing sheet and heat transfer printing method using the same wherein beautiful transfer printed articles having a clear color ton and very good color fastness can be produced by temporarily increasing the heat transferability of the coloring agent without the damage of the tinting strength thereof.

Various processes for coloring various materials have been hitherto developed and proposed, and among them there are such heat transfer printing methods as described in U.S. Pat. No. 3,363,557 and British Pat. No. 951,987.

Normally these processes comprise preparing a heat transfer printing sheet by forming any pattern on any base support by the use of an ink composition containing as a main ingredient a coloring agent such as a disperse and oil-soluble dye which is rich in sublimatability and then bringing a material to be heat transfer printed into contact with the pattern formed surface of the heat transfer printing sheet and heating them together, whereby the material to be heat transfer printed is colored by heat transfer printing the above-mentioned pattern on the former due to the sublimation of the coloring agent by heat. Therefore, these processes have very superior advantages that the coloring can be effected in a dry-heat state because a printing, steaming or washing step can be omitted.

Since the heat transfer printing method has the undermentioned disadvantages, however, the development has been greatly obstructed in spite of the presence of the above-mentioned superior advantages.

In the heat transfer printing method, namely, a disperse dye having the necessary sublimatability has been generally used as the coloring agent and as a result there is the disadvantage that the kind of material to be heat transfer printed is considerably limited.

Fibers which can be colored with the disperse dyes are principally all of the synthetic fibers including polyester fibers and triacetate fibers, but the only fiber which can be used advantageously is polyester fiber in the consideration of tinting strength and various fastness properties such as heat resistance and washing resistance and further the heat resistance of the fiber itself during the dyeing step. Therefore, the disperse dyes can not be used with advantage with other synthetic fibers, and particularly the disperse dyes can not be used for the dyeing of natural fibers such as silk, wool and cotton due to the absence by dyeability for them of disperse dyes.

Accordingly, if the range of kind of the material to be heat transfer printed is enlarged for the application in the heat transfer printing method, coloring agents other than the disperse dyes must be necessarily noted, but these coloring agents do not have the necessary heat sublimatability. Even if a heat transfer printing is effected by using these coloring agents, it is considerably difficult to obtain a very beautiful heat transfer printed product having a sufficient commodity value.

Furthermore, said heat transfer printing method has the indispensable disadvantage that the fastness of the sublimation printing is considerably poor.

Namely, since such heat transfer printing method is the process wherein the coloring is effected by diffusing and penetrating a disperse dye having a high sublimatability into the fibers, the dye is again activated to sublimate in reverse when the colored base material is subjected to heating and as a result there are the disadvantages that the colored pattern is degraded and the coloring agent contaminates other material.

Since a heat transfer printing sheet which is prepared by forming any pattern on any base support sheet by the use of an ink composition containing as a main ingredient a coloring agent such as a disperse and oil-soluble dye which is rich in sublimatability is used in the heat transfer printing process, the operator and also the apparatus for the operation are contaminated when the operator and apparatus are contacted with the pattern formed surface of the heat transfer printing sheet during the preparation and/or storage thereof and also during the heat transfer printing.

When the heat transfer printing sheets are piled up in order to store them, there are the disadvantages that the coloring agent which constitutes the printed pattern in one heat transfer printing sheet is transferred and penetrated into the base support sheet itself of the heat transfer printing sheet and/or the base support sheet of the other heat transfer printing sheet to contaminate it and consequently the quantity of the coloring agent of the former heat transfer printing sheet is decreased. When it is used, therefore, the concentration of the coloring agent to be heat transfer printed is gradually faded, or even if the heat transfer printing is effected the color tone obtained is not clear, or in a very bad case it can not be used on that the heat transfer printing sheet is unsatisfactory.

In certain cases, the coloring agent which constitutes the printed pattern of the heat transfer printing sheet can not be transferred on a material to be heat transfer printed but escapes into the side of the base support sheet and as a result even if the heat transfer printing is effected the color tone obtained is not clear or in a very bad case it can not be used.

The first object of the present invention is to provide a heat transfer printing sheet which can produce a beautiful heat transfer printed article having a very clear color tone and various fastnesses.

The second object of the present invention is to provide a heat transfer printing sheet which can produce a heat transfer printed article having a superior fastness for sublimation.

The third object of the present invention is to provide a heat transfer printing sheet which can enlarge the range for the application of the material to be heat transfer printed.

The fourth object of the present invention is to provide a heat transfer printing method using the above-mentioned heat transfer printing sheet.

As a result of our investigation in order to attain the above-mentioned objects we have found that when a basic dye having a poor transferable property based upon the phenomena such as heat-melting, -evaporation or -sublimation is acted with an alkaline agent, the heat-transferability of the basic dye can be temporarily increased by the occurrence of change of phenomena such as heat-melting, -evaporation or -sublimation due to heat, and thereby a basic dye having a poor heat transferable property can be used as a coloring agent for the heat transfer printing method. Consequently the range for the application of the material to be heat transfer printed can be enlarged, and after the above-mentioned coloring agent is transferred onto the material to be heat transfer printed the basic dye is returned to the original basic dye having various superior fastness properties and as a result a beautiful transfer printed article having very clear tone and various fastness properties can be obtained.

Furthermore we found that when a heat transfer printing sheet having a resin film on the surface of the pattern on the heat transfer printing sheet and/or on the right side surface and/or the back side surface of the base support sheet of the heat transfer printing sheet is used, the operator and apparatus are not contaminated at the time of the preparation and/or the storage of the heat transfer printing sheet. Also, when the heat transfer printing sheets having the resin film are stored in the form of a pile the basic dye on one sheet does not transfer to the other sheet and therefore the disadvantages that the concentration of basic dye is decreased, the heat transfer printing is impossible and the transfer print is unclear are eliminated.

The present invention will be better understood from the following description taken in connection with the accompanying drawings in which.

Firstly, the structure of the heat transfer printing sheet will be explained. As such heat transfer printing sheet there are various structures depending upon the position of the resin film in the sheet.

Figure 1:
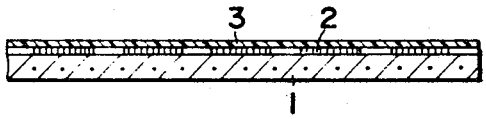
FIG. 1 is a vertical sectional view of one embodiment of the heat transfer printing sheet according to the present invention.

In the heat transfer printing sheet as shown FIG. 1, a pattern 2 comprising a binder, a basic dye having a poor transferable property based upon the phenomena such as heat-melting, -evaporation or -sublimation and an alkaline agent is formed on a base support sheet 1 and then a resin film 3 is formed thereon.

Figure 2:
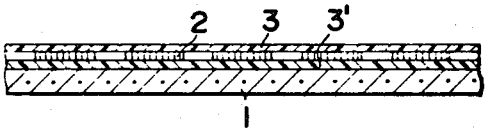
FIG. 2 is a vertical sectional view of another embodiment of the sheet according to the present invention.

In the heat transfer printing sheet as shown in FIG. 2, a resin film 3' is firstly formed on a base support sheet 1 and then a pattern 2 comprising a binder, a basic dye having a poor transferable property based upon the phenomena such as heat-melting, -evaporation or -sublimation and an alkaline agent is formed on the resin film 3' and further a resin film 3 is formed thereon.

Figure 3:
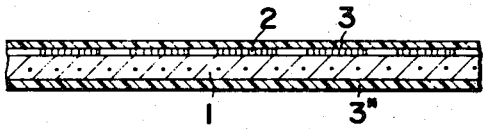
FIG. 3 is a vertical sectional view of a further embodiment of the sheet according to the present invention.

In the heat transfer printing sheet as shown in FIG. 3, a pattern 2 comprising a binder, a basic dye having a poor transferable property based upon the phenomena such as heat-melting, -evaporation and -sublimation and an alkaline agent is formed on a base support sheet 1 and then a resin film 3 is formed thereon and on the other hand a resin film 3'' is formed on the back side surface of the base support sheet 1.

Figure 4:
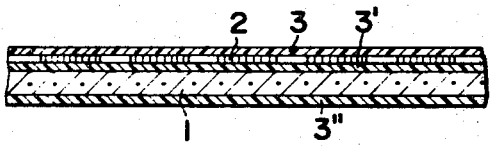
FIG. 4 is a vertical sectional view of still another embodiment of the sheet according to the present invention.

In the heat transfer printing sheet as shown in FIG. 4, a resin film 3' is formed on a base support sheet 1 and then a pattern 2 comprising a binder, a basic dye having a poor transferable property based upon the phenomena such as heat-melting. -evaporation or -sublimation and an alkaline agent is formed on the resin film 3' and further a resin film 3 is formed on the pattern 2 and on the other hand a resin film 3'' is formed on the back side surface of the base support sheet 1.

Figure 5:
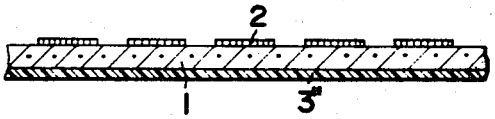
FIG. 5 is a vertical sectional view of a still further embodiment of the sheet according to the present invention.

In the heat transfer printing sheet as shown in FIG. 5, a pattern 2 comprising a binder, a basic dye having a poor transferable property based upon the phenomena such as heat-melting, -evaporation or -sublimation and an alkaline agent is formed on a base support sheet 1 and on the other hand a resin film 3'' is formed on the back side surface of the base support sheet 1.

In the above heat transfer printing sheet of the present invention, due to the action of the basic dye having a poor transferable property based upon the phenomena such as heat-melting, -evaporation or -sublimation with an alkaline agent, changes of the above phenomena of the basic dye occur and as a result the heat transferable property of the basic dye can be temporarily increased and thus it becomes possible to use such a basic dye as a coloring agent in the heat transfer printing method.

In the heat transfer printing sheet, also, by the provision of the resin film, a contamination of the pattern surface of the heat transfer printing sheet due to contact and contamination generated by penetrating and transferring the basic dye and alkaline agent into the base support sheet of the heat transfer printing sheet can be improved. And further even if the heat transfer printing sheets are piled to store them, the basic dye and alkaline agent do not transfer from one sheet to another sheet. Since the basic dye and alkaline agent do not transfer and pass through the base support sheet itself of the heat transfer printing sheet, furthermore, the concentration of the basic dye as the coloring agent does not decrease, the heat transfer print is not unclear and the heat transfer printing is not impossible.

Particularly, since the basic dye and alkaline agent co-exist in the pattern of the heat transfer printing sheet, the transferability of the basic dye increases due to the action of the basic dye with the alkaline agent, but the transferability of the basic dye can be effectively inhibited during the storage of the sheet and thus the sheet has a superior storage-stability, because the resin film is formed in the heat transfer printing sheet.

In the heat transfer printing sheet, the transferability of the basic dye in the pattern of the sheet can be inhibited due to the provision of the resin film even if the temperature of the storage room is rapidly increased during the storage of the sheet and so the storage-stability can be increased.

As examples of the base support sheet which may be used according to the present invention, it is preferable to use one which is not affected under various conditions for forming optional patterns and also heat transfer printing and therefore there are mentioned for example various kind of papers and converted papers, cellophane, films and sheets of various resins having a thermal resistance, various metal foils and plates and laminated films made thereof.

The basic dye which is used according to the present invention includes basic dyes and cationic dyes which have not been substantially used in the prior sublimation transfer printing methods and which have a comparatively poor heat transferability for the heat transfer printing of these dyes onto other base materials due to phenomena such as heat-melting, -evaporation or -sublimation.

The above mentioned dyes are for example methine (cyanine) type basic dyes or cationic dyes such as the mono-methine type, di-methine type or trimethine type dyes, for example 3,3'-diethyloxacyanine iodide, Astrazon Pink FG (C.I. 48015), 2,2'-carboxyanine (C.I. 808), Astra Phloxine FF (C.I. 48070), Astrazon Yellow 7GLL (C.I. Basic Yellow 21), Aizen Cathilon Yellow 3GLH (C.I. 48055) and Aizen Cathilon Red 6BH (C.I. 48020); diphenylmethane type basic dyes or cationic dyes such as Auramine (C.I. 655); triphenylmethane type basic dyes or cationic dyes such as Malachite Green (C.I. 42000), Brilliant Green (C.I. 42040), Magenta (C.I. 42510), Methyl Violet (C.I. 42535), Crystal Violet (C.I. 42555), Methyl Green (C.I. 684) and Victoria Blue B (C.I. 44045); xanthene type basic dyes or cationic dyes such as pyronine G (C.I. 739), Rhodamine B (C.I. 45170) and Rhodamine 6G (C.I. 45160); acridine type basic dyes or cationic dyes such as Acridine Yellow G (C.I. 785), Rheomine AL (C.I. 46075), Benzoflavine (C.I. 791), and phosphine (C.I. 46045); quinoneimine type basic dyes or cationic dyes such as Neutral Red (C.I. 50040), Astrazon Blue BGE/X 120% (C.I. 51005) and Methylene Blue (C.I. 52015); and other basic or cationic dyes such as anthraquinone type dyes having a quaternary amine.

According to the present invention, there are the advantages that the basic dye which is difficult to use in the prior art can be applied for the heat transfer printing method and also thereby the range for the application of the material to be heat transfer printed can be enlarged.

According to the present invention, furthermore, there is the advantage that the basic dyes which have a comparatively high heat transferability property can be sufficiently used in the presence of the base and therefore milder heat transferable conditions can be used.

As the alkaline agent which can be used in the heat transfer printing of the present invention, an alkaline agent having the property of increasing the heat-transferability of a basic dye by its action with the basic dye can be used.

As examples of the alkaline agents, there are mentioned illustratively for example alkali metal hydroxide such as lithium, sodium and potassium hydroxide; alkaline earth metal hydroxides such as beryllium, magnesium, calcium and strontium hydroxides; salts of strong and weak bases with weak acids such as lithium, sodium, potassium, magnesium, barium and strontium carbonates and sodium acetate; bases such as aqueous ammonia and amines such as dimethyl formamide, ethandiamine and triethanolamine.

The amount of the alkaline agent used is preferably 1/10 to 20 molar equivalent of alkaline agent per molar equivalent of basic dye and more preferably is 1 to 10 molar equivalent of alkaline agent per molar equivalent of basic dye.

The heat transfer printing sheet may include, if necessary in addition to the binder, basic dye and alkaline agent, a coloring assistant having the effect that it penetrates into the material to be heat transfer printed at the time of heat transfer printing to swell the intermicelles and thereby to increase the penetration of basic dye, or various addition agents which can regulate the state of the composition comprising a binder, basic dye and alkaline agent can be used.

The coloring assistant includes for example, urea, naphthalene, ammonium tartrate, glycine A, oxalates of aliphatic amines such as cyclohexylamine, ammonium acetate, benzylamine and various surface active agents having anionic, nonionic or amphoteric properties and further the addition agents include for example a plasticizer, stabilizer, wax, grease, drier, auxiliary drier, hardener, emulsifier, viscosity increasing agent, filler and dispersing agent.

According to the heat transfer printing sheet of the present invention, the resin which can constitute the resin film includes polyvinyl alcohol, sodium polyacrylate, mayprogum, dextrin, methyl cellulose, carboxymethyl cellulose, polyvinyl-pyrrolidone, vinylmethylether-acrylic acid copolymer, water-soluble thermosetting acrylic resin, rosin modified maleic resin, ester gum, rosin modified phenol resin, xylene resin, polyvinyl chloride, polyvinyl acetate, polyacrylic ester, polyamide, polyurethane, polyester, butyral resin, epoxy resin, urea resin, melamine resin, aceto-butyric cellulose, thermal setting acrylic resin, polystyrene and petroleum resin.

As the resin film which is formed by using said resin, in principle, any resins can be used. For instance, the resin film 3 on the pattern 2 in the heat transfer printing sheets shown in FIGS. 1, 2, 3 and 4 can inhibit contamination which is generated by contacting the surface of the pattern 2 of the heat transfer printing sheet with any substance, or contamination which is generated by transferring the basic dye and alkaline agent to another heat transfer printing sheet at the time of storage.

However, it is necessary that not only can the resin film 3 which is applied on the pattern surface 2 inhibit the contamination and increase the stability for storage but also it can not impair the heat transfer printability due to the passage of the basic dye at the time of the heat transfer printing, because the object of the present invention is to urately print the pattern on a material to be heat transfer printed by a heat transfer printing method. In such consideration, it is preferable that particularly water-soluble resins such as polyvinyl alcohol, sodium polyacrylate, and polyvinylpyrrolidone and oil-soluble resins such as xylene resin, rosin modified phenol resin, butyral resin, epoxy resin, polystyrene and petroleum resin are used as the resins employed for providing the resin film on the patterns.

It is preferable that the thickness of the resin film be thin.

Insofar as the resin film of the heat transfer printing sheet according to the present invention is concerned, the resin film 3' which is applied on the right side surface of the base support sheet 1 of the heat transfer printing sheet as shown in FIGS. 2 and 4 is useful to inhibit the problems that the basic dye and the alkaline agent in the pattern 2 of the heat transfer printing sheet are passed into and transmitted through the base support sheet 1 during the production and/or the storage of the heat transfer printing sheet to thereby decrease the amount of the basic dye which is present in the pattern 2 and that the basic dye is transmitted through the base support sheet 1 to the back side surface to thereby create contamination.

As the material of the resin film 3' which is applied on the right side surface of the base support sheet of the heat transfer printing sheet, therefore, it is preferable to use a resin having the property of inhibiting the passing into and transmitting through the base support sheet of the basic dye and the alkaline agent in the pattern of the heat transfer printing sheet.

Moreover, the resin film 3" which is applied on the back side surface of the base support sheet 1 of the heat transfer printing sheet is useful to inhibit the problems that when the heat transfer printing sheets are stored by piling, the basic dye and the alkaline agent in the pattern 2 of one heat transfer printing sheet are passed into the base support sheet 1 of another heat transfer printing sheet with the elapse of time to create a contamination of the heat transfer printing sheet, or the basic dye and the alkaline agent are passed into and transmitted through the base support sheet 1 to create a contamination of the heat transfer printing sheet and thereby the amount of the basic dye which is present in the pattern 2 of the heat transfer printing sheet is decreased. Also the when the heat transfer printing sheet is used the concentration of the color of the heat transfer print is gradually decreased, and the heat transfer print is unclear and in a very bad case the use of the heat transfer printing is impossible.

As the material of the resin film which is applied on the back side surface of the base support sheet of the heat transfer printing sheet, therefore, it is preferable to use a resin having a property of inhibiting the passing into and transmitting through the base support sheet itself or the other base support sheet of the basic dye and the alkaline agent in the pattern of the heat transfer printing sheet during its storage.

The formation of the pattern comprising a binder, basic dye and alkaline agent on the base support sheet can be carried out by various methods with the heat transfer printing sheet of the present invention.

In one method an ink or paint composition comprising as a main component a binder, basic dye and alkaline agent is applied onto any base support sheet as an optional mono- or multi-color pattern of for example a letter, mark or figure by a normal printing, drawing or painting method, and thereby an optional mono- or multi-color pattern is formed on the base support sheet.

As an alternative procedure, an ink or paint composition comprising as a main component a binder and basic dye is firstly applied onto any base support sheet as an optional mono- or multi-color pattern by a normal printing, drawing or painting method and then a composition comprising as a main component an alkali agent is secondly applied on the above optional pattern, and thereby an optional mono- or multi-color pattern is formed on the base support sheet.

As another alternative procedure, inversely, a composition comprising as a main component an alkaline agent is firstly applied onto any base support sheet as an optional pattern by the same method as the above and then an ink or paint composition comprising as a main component the binder and the basic dye is secondly applied onto the optical pattern, and thereby an optional mono- or multi-color pattern is formed on the base support sheet.

As a further alternative procedure, an ink and paint composition comprising as a main component a binder and a basic dye which is previously treated with a composition comprising as a main component an alkaline agent is applied as described above by a normal printing, drawing or painting method to form a mono- or multi-color pattern thereon.

As a process for forming the resin film in the heat transfer printing sheet, for example a resin composition containing the resin as a main component is coated by a normal coating method such as the roll-coating method, gravure-coating method, bar-coating method, air-knife coating method and silk-screen coating method, or a film or sheet which is produced by a normal method from the resins is laminated to form the resin film. The quantity of resin to be coated is preferably 0.2–4.0 g/m$^2$ depending upon the kind of resin.

According to the present invention, it is preferable to produce a heat transfer printing sheet by selecting the most beneficial method from the above-mentioned methods for the production thereof depending upon the desired purpose and the kind of materials used.

In the present invention, if necessary not only one layer but also two or more layers of the resin film can preferably be coated or laminated.

It is necessary not to affect the pattern provided on the base support sheet when coating the resin, for example it is necessary not to damage the letter, mark and figure provided on the base support sheet.

In the process for preparing the transfer printing sheet, the various processes may be used together; or the basic dye and the alkaline agent are respectively made in the form of microcapsules by a normal process and both microcapsules can be broken under the heat transfer printing condition as described hereinafter to react with each other.

The optional pattern which may be formed on a base support sheet may be a wholly covered layer containing the binder, basic dye and alkaline agent.

As examples of the binder which may be used for the process for producing the above heat transfer printing sheet, there are mentioned well known binders such as for example, methyl cellulose, ethyl cellulose, carboxymethyl cellulose, cellulose acetate, cellulose butyrate and sodium alginate and its derivatives; polyvinyl alcohol; polyvinyl acetate; polycarbonate resin; polyester resin; polyamide resin; phenol resin; amino plast resins; homopolymers or copolymers of various vinyl monomers, for example, unsaturated carboxylic acids such as acrylic acid, methacrylic acid, itaconic acid, fumaric acid and maleic acid or ester-, nitrile- or amide derivatives of these unsaturated carboxylic acids, vinyl chloride, vinylidene chloride, vinyl acetate, styrene, vinylpyrrolidone, vinyl methyl ether, butadiene, ethylene and propylene; starch; gum arabic; tragacanth gum and gelatin.

The binders which are softened or melted at the heating temperature under the heat transfer printing conditions are not preferable for the purpose of the present invention. When the binders which are softened or melted are used, the binders themselves are also heat transfer printed on the base material to be heat transfer printed and consequently heat transfer printed articles having a poor handling quality are obtained.

In the process for the production of the heat transfer printing sheet, the composition comprising a basic dye, alkaline agent and binder is in any state, for example a solution-, emulsion-, suspension- or sol-state.

Figure 6:
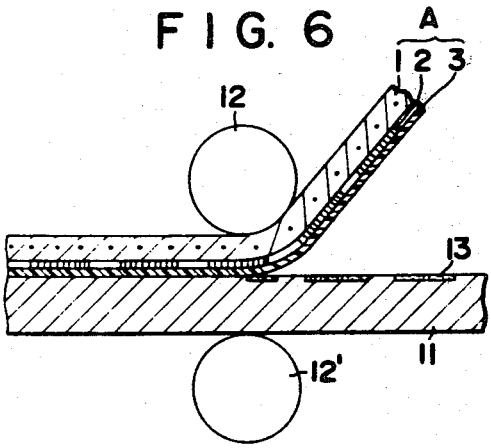
FIG. 6 is a vertical sectional view which shows one embodiment of the heat transfer printing method using the heat transfer printing sheet as shown in FIG. 1.

The process for heat transfer printing according to the present invention is explained in the following:

A process for heat transfer printing using the heat transfer printing sheet as shown in FIG. 1 is explained in connection with FIG. 6. In FIG. 6, the heat transfer printing sheet A is laminated with the material 11 to be heat transfer printed so as to contact the surface of the resin film 3 of sheet A with the surface of material 11, and the whole is heat-treated under pressure by passing through two heated rollers 12, 12' and then the above heat transfer printing sheet A is stripped off from the material 11 to be heat transfer printed. By such procedure, only the basic dye in any pattern 2 on the heat transfer printing sheet A is heat transfer printed on said material 11 to be heat transfer printed due to phenomena such as heat-melting, -evaporation or -sublimation and on the other hand the binder and alkaline agent which constitute the pattern of the heat transfer printing or the resin film 3 remain in the heat transfer printing sheet A at the time of stripping of the sheet A, and thereby a heat transfer printed product having a heat transfer printed pattern 13 which is rich in various fastness properties and has a very clear color tone can be obtained.

In case of the heat transfer printing sheets as shown in FIGS. 2, 3, 4, and 5 a heat transfer printing can be still carried out by the same heat transfer printing process, and it is not necessary that the heating temperature be a temperature which is near to or higher than the melting or sublimating point of the basic dye itself which is used for the production of the heat transfer printing sheet. Although the heating temperature is varied depending upon the kind of the basic dye it is preferable to optionally select from a range of about 80° to 250° C.

The condition of the pressure is preferably about 50 to 20 kg/cm$^2$.

The duration of the heating and pressing treatment is preferably about 30 to 90 seconds.

In the present invention, furthermore, a heat transfer printing process may be carried out wherein using the heat transfer printing sheet formed with the color layer containing the coloring agent and binder which is covered on the whole surface thereof, a masking member having an optional open pattern is laminated on the color layer of the heat transfer printing sheet, and then a material to be transfer printed is laminated on the masking member and the whole is heated under pressure.

As examples of the masking member, there are mentioned stencil papers for mimeographing such as stencil paper for hand writing, typewriting and ball pen writing, and heat sensitive stencil paper which is formed with an optional open pattern such as a letter, mark or figure; screen printing plates (stencil for screen printing) having an optional pattern for use in screen printing; and films and sheets of various synthetic resins, various papers and various metal foils and thin metal sheets which are formed with an optional open pattern such as a letter, mark, figure or design by punching or corroding treatment.

In addition to the above masking member, it is possible to use photosensitive dry films such as Liston film (Du pont) and Raminer film (Dyanachem) which are formed with an optional open pattern by normally exposing, developing and fixing. The material to be heat transfer printed which may be used in the process for heat transfer printing according to the present invention includes vegetable fibers such as cotton and hemp fibers; animal fibers such as wool and silk fibers; glass fiber; rayon fiber, acetate and staple fibers; various fibers such as polyamide, polyester, polyacrylonitrile, polypropylene, polyvinyl chloride and polyvinyl alcohol fibers; films and sheets of various synthetic resins; various papers; foils and plates of various metals; glass plate; potteries; leather, collagen and synthetic leather; rubber sheet and mold; wood; plywood; slate plate; hard board; gypsum board; complex materials made of organic compounds and inorganic compounds.

The process for heat transfer printing can be simply carried out by the use of a heating iron at the time of heating under pressure and consequently this process is easy to carry out.

According to the present invention, after an optional pattern is heat transferred on the material to be heat transfer printed, the base material is subjected to a steam heating or acid-steam heating treatment, and thereby a clearer coloring can be effected. It is worth noting in this case that the treating time, namely using the basic dye, is very much shorter than that of the prior printing method using a coloring ink containing vehicle.

As is clear from the above explanation, according to the present invention, a heat transfer printing procedure is provided using a heat transfer printing sheet in which an optional pattern comprising a basic dye having a poor heat transferable property based upon heat-melting, -evaporation or -sublimation phenomena and an alkaline agent having the property of increasing the heat transferable property through the action of the basic dye with the base is formed on a base support sheet.

Therefore, there are obtained the very valuable advantages that the operating conditions are not so harsh and coloring agents which were scarcely used in the prior sublimation transfer printing process due to the fact that the phenomena such as heat-melting, evaporation or -sublimation are comparatively poor can be applied for the sublimation transfer printing process.

As a result, according to the present invention the application range of the material to be transfer printed can be very much enlarged by the fact that because of the coloring agent used in the prior sublimation transfer printing process, the fiber as the material to be heat transfer printed was limited to polyester type fiber. In the process of the present invention, on the other hand, by suitably selecting the coloring agent a fiber which is suitable for coloring with said coloring agent can be easily colored. By using the basic dye, for example a synthetic fiber such as polyacrylonitrile fiber and animal fibers such as silk and wool can be colored.

In the process of the present invention, the heat transferable property can be considerably increased by reacting the coloring agent which was used in the prior sublimation transfer printing process as well as the coloring agent which was scarcely used in the prior sublimation transfer printing process due to the fact that the phenomena such as heat-melting, -evaporation or -sublimation thereof is poor with the alkaline agent. Also, once the coloring agent is heat transfer printed on the material to be heat transfer printed, it is returned to its original state. Therefore, the fixed color has various considerable superior fastness properties such as weather resistance, abrasion resistance, heat resistance, solvent resistance, water resistance and chemical resistance. By applying furthermore a steam heating treatment, a heat transfer printed product having a clearer color tone can be obtained.

As is clear from the above explanation, by using the heat transfer printing sheet of the present invention, the storage life and ease of handling are improved and the contamination is decreased. Therefore there is the additional advantage that the value of the commodity can be highly increased.

The present invention will be explained in more detail with reference to the following Examples in which parts are parts by weight.

EXAMPLE 1

Parchment paper having the weight of 64 g/m$^2$ was printed with the desired pattern in a gravure printing machine using the yellow, red and blue inks having the following respective composition to obtain a multi-color printed material.

The printing speed was 30 m/min. Then the multi-color printed material was coated by using 15% aqueous solution of polyvinyl alcohol in a gravure rotary printing machine to obtain a heat transfer printing sheet. The coating speed was 20 m/min. The drying was also completely carried out. The coating quantity was about 1.2 g/m$^2$.

The contamination of the heat transfer printing sheet having an overcoat resulting from time lapse was compared with that of the heat transfer printing sheet having no overcoat. The sheet of the present invention shows a storage life of about 3 months and about 3 to 4 times storage life in comparison with the sheet having no overcoat. Similar results were obtained with the heat transfer printing sheets which were applied with an overcoat having respectively the coating quantities of about 2 g/m$^2$ and consisting of two layers of sodium polyacrylate, polyvinyl pyrrolidone or polyvinyl alcohol and butyral resin or polystyrene in the place of polyvinyl alcohol which is a water-soluble resin. The heat transfer printing method using the heat transfer printing sheet which is prepared as above was carried out as follows:

The above heat transfer printing sheet was laminated with a plain weave cloth made of polyacrylonitrile fibers having a thickness of 0.4 mm and then the whole was heated by a heated plate at 190° C. for 75 seconds. The parchment paper of the above heat transfer printing sheet was stripped to give clear yellow-, red- and blue-color heat transfer printed cloths. The obtained printed cloths show a good fastness, namely washing fastness grade 5, abrasion fastness grade 5, drycleaning fastness grade 5 in the Japanese Industrial Standard and the sublimation fastness shows grades 4 to 5 at 180° C. for 15 seconds.

TABLE OF INK COMPOSITION

| | |
|---|---|
| (1) Yellow ink | |
| Aizen Cathilon Yellow 3GLH | 10 parts |
| $Na_2CO_3$ | 10 parts |
| Ethyl cellulose | 10 parts |
| Xylene-Ethanol (8:2) | 70 parts |
| Total | 100 parts |
| (2) Red ink | |
| Aizen Cathilon Red 6BH | 10 parts |
| $Na_2CO_3$ | 10 parts |
| Ethyl cellulose | 10 parts |
| Xylene Ethanol (8:2) | 70 parts |
| Total | 100 parts |
| (3) Blue ink | |
| Astrazon Blue BG E/X | 10 parts |
| $Na_2CO_3$ | 10 parts |
| Ethyl cellulose | 10 parts |
| Xylene: Ethanol (8:2) | 70 parts |
| Total | 100 parts |

EXAMPLE 2

Example 1 was repeated except that in the place of the water-soluble resin which was used for the overcoat butyral resin was used and was dissolved in a mixed solvent of toluene-alcohol to prepare a 15% solution and the coating quantities were about 2.0 g/m$^2$.

The obtained heat transfer printing sheet shows a good result similar to Example 1 in the point of the storage life and heat transferring property due to the time lapse.

When oil-soluble resins such as polystyrene, epoxy resin, petroleum resin and xylene resin were used in the place of butyral resin in the above example, similar results were obtained.

EXAMPLE 3

The under-mentioned painting liquid was undercoated on Simili paper having the weight of 55 kg/m$^2$ in a rotary gravure printing machine. The drying was sufficiently carried out. The painting quantities were 2 to 3 g/m$^2$. Then the paper with the undercoat was printed with the ink composition as used in Example 1 by the same procedure of Example 1 in a gravure printing machine to obtain a multi-color printed material. The under-mentioned coating liquid was coated on the printed surface of the above multi-color printed material to obtain a heat transfer printing sheet with an overcoating layer. The coating method is carried out as in Example 1. The painting quantity of the coating was about 1 to 2 g/m$^2$.

The storage life of the heat transfer printing sheet having an undercoat and overcoat was compared with that of the heat transfer printing sheet having no undercoat and overcoat.

The process for the testing of contamination of these transfer printing sheets was as follows:

The ink-printed surface of the transfer printing sheet was laminated with one white paper (white paper 1) and also the non-printed surface of the transfer printing sheet was laminated with one white paper (white paper 2) and then the whole was charged in a blocking tester for storage at 30° C. for three months therein, and thereby the contamination of the transfer printing sheet was determined by the contamination degree of the white papers 1 and 2.

In the transfer printing sheet having no undercoat and overcoat, white papers 1 and 2 were extremely contaminated. In the transfer printing sheet having an undercoat and overcoat which are applied thereon by using the undermentioned resins, on the other hand, a good storage life was attained and the contamination of white papers 1 and 2 could hardly be found.

The heat stability of the transfer printing sheet having an undercoat and overcoat was good similarly to Example 1 and a clear colored cloth was obtained.

The compositions of coating liquids for the undercoat and overcoat are shown in the following Table.

TABLE

| | Undercoating liquid | Overcoating liquid |
|---|---|---|
| 1 | 15% aqueous solution of polyvinyl alcohol | 15% aqueous solution of polyvinyl alcohol |
| 2 | 15% aqueous solution of polyvinyl alcohol | 15% solution of butyral resin in (toluene-IPA) |
| 3 | 15% solution of butyral resin in(toluene-IPA) | 15% aqueous solution of polyvinyl alcohol |
| 4 | 15% solution of butyral resin in(toluene-IPA) | 15% solution of butyral resin in(toluene-IPA) |

The following resins were used in the place of the resins used for the undercoating liquid as described in the Table. Respectively similar results as the above were obtained.

In Nos. 1 and 2 in the Table, sodium polyacrylate, dextrine or polyvinylpyrrolidone was used.

In Nos. 3 and 4 in the Table, rosin modified phenol resin, xylene resin, polystyrene, epoxy resin or petroleum resin was used.

The following resins were used in the place of the resins used for the overcoating liquid as described in the Table. Respectively similar results as the above were obtained.

In Nos. 1 and 2 in the Table, sodium polyacrylate, polyvinylpyrrolidone, two coats of polyvinyl alcohol and butyral resin or polystyrene was used.

In Nos. 3 and 4 in the Table, xylene resin, rosin modified phenol resin, polystyrene, epoxy resin or petroleum resin was used.

EXAMPLE 4

When the overcoating liquid was coated in Examples 2 and 3, the dye on the heat transfer printing sheet was dissolved into the solvent of the above liquid depending upon the kinds of dyes and because of this the sheet was often liable to be contaminated. In such case, a first overcoat was preliminarily applied using 15% aqueous solution of polyvinyl alcohol (coating quantity: 0.5 to 1.0 g/m$^2$) and then was sufficiently dried and thereafter a second overcoat was finally applied using 15% solution of polystyrene in a mixed solvent of gasoline for rubber, ligroin and toluene (3:3:4). By such two coats the contamination during coating could be prevented.

The storage life and heat transfer printing property of the heat transfer printing sheet which was obtained in this way were good.

EXAMPLE 5

An undercoat was provided on Simili paper having the weight of 55 kg/cm$^2$ using 15% aqueous solution of polyvinyl alcohol. After the undercoat was sufficiently dried an agent layer was coated thereon using an alkali solution in which 60 parts of NaOH were dissolved in 960 parts of 6% aqueous solution of methyl cellulose 65SH50 and then sufficiently dried. A red ink was obtained by adding 120 parts of ethylcellulose N7CP and 100 parts of Aizen Cathilon Red 6BH (C.I. 48020) into 780 parts of mixed solvent of xylene and butanol (8:2) and by sufficiently kneading the whole in a ball mill. The above alkaline agent layer was printed with the red ink in a gravure printing machine to form a desired pattern.

Thereafter, an overcoat was formed onto the pattern by using 15% solution of butyral resin in a mixed solvent of toluene and isopropyl alcohol (7:3) in a gravure printing machine to obtain a heat transfer printing sheet. The coating quantity was about 1.2 g/m$^2$.

The storage life of the above sheet is good and the transfer printing property is good when the transfer printing was carried out as described in Example 1.

A heat transfer printing sheet having a similar storage life as described above and superior transfer printing property when sodium acrylate, dextrine, epoxy resin or xylene resin was used in the place of polyvinyl alcohol as the resin of the undercoat and also two coats consisting of polystyrene or polyvinyl alcohol and butyral resin or polystyrene were used in the place of butyral resin as the resin of the overcoat.

EXAMPLE 6

Example 5 was repeated except that the ink pattern layer was firstly printed and then the oxidizing agent layer was secondly coated. This transfer printing sheet had similarly a good storage life and heat transferability.

EXAMPLE 7

80 parts of Crystal Violet (C.I. 42555) were dissolved in 1720 parts of water and then 200 parts of 4% NaOH aqueous solution were gradually added thereto and after the completion of addition the solution was left to stand. The formed precipitate was filtered off, washed with water and then sufficiently dried. 70 parts of Crystal Violet treated with the above alkali and 120 parts of ethyl cellulose N7CP were mixed and the whole was sufficiently kneaded in a ball mill to obtain a violet ink composition.

An undercoat was provided on Simili paper having the weight of 55 kg/m$^2$ using 15% aqueous solution of polyvinyl alcohol. After the undercoat was sufficiently dried the above violet ink composition was printed on the above undercoat to obtain a printed matter formed with the desired pattern. The obtained printed matter was provided with an overcoat thereon by using 15% aqueous solution of polyvinyl alcohol to obtain a heat transfer printing sheet. The coating quantity was about 1.2 g/m$^2$.

The storage life and heat transfer printing property of the obtained transfer printing sheet was good.

A heat transfer printing sheet having a similar storage life as described above and superior transfer printing property was obtained when sodium acrylate, dextrine, epoxy resin or xylene resin were used in the place of polyvinyl alcohol as the resin of the undercoat and also two coats consisting of polystyrene or polyvinyl alcohol and butyral resin or polystyrene were used in the place of polyvinyl alcohol as the resin of the overcoat.

EXAMPLE 8

4 parts of NaOH were dissolved in 95 parts of 4% aqueous solution of methyl cellulose and this aqueous solution containing an alkaline agent was coated on parchment paper having the weight of 64 g/m$^2$ in a gravure printing machine and then the coating was sufficiently dried.

100 parts of ethyl cellulose N7CP and 100 parts of Aizen Cathilon Red 6BH were mixed together with 800 parts of a mixed solvent of xylene and butanol (8:2) and the whole was sufficiently kneaded to obtain a red ink. The desired pattern was printed in a gravure printing machine on the sheet coated with the alkaline agent using the above red ink.

An overcoat was applied on the above printed surface of the sheet in a gravure printing machine using 15% aqueous solution of polyvinyl alcohol and the overcoat was sufficiently dried to obtain a heat transfer printing sheet.

A similar heat transfer printing sheet was also obtained when polyvinyl butyral, polystyrene or two coats consisting of polyvinyl alcohol and butyral resin or polystyrene were used.

EXAMPLE 9

Example 8 was repeated except that the coat of alkaline agent was applied on the printed pattern and then the overcoat was applied on the coat of alkaline agent. A similar result was obtained.

EXAMPLE 10

80 parts of Crystal Violet (C.I. 42555) were dissolved in 1720 parts of water and 200 parts of 4% aqueous solution of NaOH were gradually added to the dye solution. After the completion of the addition the whole was left to stand. The formed precipitate was filtered off, washed with water and sufficiently dried. Then 70 parts of Crystal Violet treated with the above alkali and 120 parts of ethyl cellulose N7CP were mixed with 810 parts of a mixed solvent of xylene and butanol (8:2) and the whole was sufficiently kneaded in a ball mill to obtain a violet ink composition.

The desired pattern was printed on parchment paper having the weight of 64 g/m$^2$ in a gravure printing machine using the above violet ink composition. Then an overcoat was applied on the printed pattern in a gravure printing machine using 15% aqueous solution of polyvinyl alcohol to obtain a heat transfer printing sheet.

EXAMPLE 11

Example 1 was repeated except that a laminate of aluminum foils was used in the place of parchment paper having the weight of 64 g/m$^2$ as the base support sheet. A similar heat transfer printing sheet was obtained.

EXAMPLE 12

100 parts of gelatin were sufficiently dissolved in 90 parts of water. The obtained solution was coated on the back of paper used for gravure printing and then was sufficiently dried. The coating quantity was about 1 to 2 g/cm$^2$. Using three inks having the following compositions, the surface of the above paper was multi-color printed by employing a gravure printing machine to prepare a sheet.

TABLE OF INK COMPOSITIONS

| | |
|---|---|
| (1) Yellow ink | |
| Aizen Cathilon Yellow 3GLH | 50 parts |
| $Na_2CO_3$ | 50 parts |
| Ethylcellulose N7CP | 120 parts |
| Xylene: Butanol (8:2) | 780 parts |
| (2) Red ink | |
| Aizen Cathilon Red 6BH | 50 parts |
| $Na_2CO_3$ | 50 parts |
| Ethylcellulose NCP | 120 parts |
| Xylene: Butanol (8:2) | 780 parts |
| (3) Blue ink | |
| Astrazon Blue BGE/X 120% | 50 parts |
| $Na_2CO_3$ | 50 parts |
| Ethylcellulose N7CP | 120 parts |
| Xylene: Butanol (8:2) | 780 parts |

The printed surface of the above prepared sheet was gravure-coated with a solution of 3 parts of sodium alginate in 97 parts of water by a gravure printing machine to obtain a heat transfer printing sheet.

When the heat transfer printing sheet was left to stand for 30 days at the temperature of 30° C. in its wound state, any contamination of the back of the heat transfer printing sheet was almost not found. Also, when a polyacrylonitrile fiber cloth was heat transfer printed by using this heat transfer printing sheet for 75 seconds with a press machine which was heated at the temperature of 190° C., a good multi-color heat transfer printed cloth was obtained.

Similar results were obtained when the following resins were used for the coating in place of gelatine which was used as an undercoat agent in the above.

| Composition of coating liquids | | |
|---|---|---|
| Resin used | Solvent used | Resin (%) |
| Polyvinyl alcohol | Water | 7 |
| Methylcellulose | Water | 6 |
| Rosin modified phenol resin | Toluene | 20 |
| Butyral resin | IPA | 10 |
| Polystyrene | Toluene | 15 |
| Polyvinylalcohol: gelatine | Water | 8(6:2) |

Similar results were obtained when the following resins were used for the gravure coating in place of sodium alginate which is the overcoat agent in the above.

| Composition of coating liquids | | |
|---|---|---|
| Resin used | Solvent used | Resin (%) |
| Methylcellulose | Water | 6 |
| PVA | Water | 7 |
| Polystyrene | Toluene | 10 |
| Polybutyral | IPA | 10 |
| Rosin modified phenol resin | Toluene | 15 |

EXAMPLE 13

100 parts of polyvinyl butyral resin were dissolved in 900 parts of xylene-ethanol (7:3) mixed solvent. A blue ink was prepared by mixing 850 parts of the above solution, 100 parts of Aizen Cathilon Blue 5G and 50 parts of 50% aqueous solution of sodium carbonate in a ball mill and then kneading them sufficiently to obtain a blue ink composition. Then a heat transfer printing sheet was obtained by gravure-printing a desired pattern with the above obtained blue ink composition on the surface of gravure paper which was coated with the resin in Example 12 to obtain a sheet. Then a heat transfer printing sheet can be obtained by gravure-coating an aqueous solution of 3 parts of sodium alginate in 97 parts of water on the ink printed surface of the above obtained sheet.

The heat transfer printing sheet has superior storage ability, anti-contaminating property and heat transfer printability similarly as in Example 1. Also, when the ink composition as shown in the following table was used in place of the above blue ink composition, heat transfer printing sheets similar to the above heat transfer printing sheets were obtained. The storage ability, anti-contamination ability and heat transfer printability were similarly good.

TABLE

| Dye | Resin | Solvent | Alkaline agent |
|---|---|---|---|
| 10 parts | 10 parts (ethylcellulose) | 72 parts xylene: butanol (= 4:1) | 8 parts (KOH) |
| 10 parts | 10 parts (ethylcellulose) | 74 parts xylene: butanol (= 4:1) | 6 parts (NaOH) |
| 10 parts | 10 parts (ethylcellulose) | 70 parts xylene: butanol (= 4:1) | 10 parts ($Na_2CO_3$) |

EXAMPLE 14

A gravure paper was coated with a solution consisting of 85 parts of water, 10 parts of polyvinyl alcohol and 5 parts of sodium hydroxide by a gravure printing procedure and then three printings were carried out using three kinds of inks as described in Example 12 and then an overcoat was applied on the right side surface of the above printed gravure paper and a coating was applied on the back side surface of the paper similarly as in Example 12.

When these heat transfer printing sheets were piled and left to stand, an offset did not occur.

EXAMPLE 15

80 parts of Crystal Violet were dissolved in 1720 parts of water and 200 parts of 5% aqueous NaOH solution were gradually added to the above dye solution and thereafter the solution was left to stand for 15 minutes. The formed precipitate was separated from the solution by filtration and then it was washed and sufficiently dried. 70 parts of the dried precipitate and 120 parts of ethylcellulose N7CP were mixed with 810 parts of a mixed solvent of xylene and butanol (8:2) and the mixture was sufficiently kneaded in a ball mill to obtain a violet ink composition. A back side surface coated paper as described in Example 12 was printed by using this ink composition and then the overcoating which was carried out as in Example 12 was effected to produce a heat transfer printing sheet. The storage stability, and heat transfer printability thereof were good.

EXAMPLE 16

10 parts of gelatine were added to and dissolved in 90 parts of water and the obtained solution was painted on a back side surface of gravure paper by a coating machine and then the paper was sufficiently dried. The painting amount was about 1 to 2 g/cm$^3$. Further the right side surface of the above printing paper was multicolor printed by a gravure printing machine to obtain a heat transfer printing sheet.

TABLE OF INK COMPOSITIONS

| | |
|---|---|
| (1) Yellow ink | |
| Aizen Cathilon Yellow 3GLH | 50 parts |
| $Na_2CO_3$ | 50 parts |
| Ethylcellulose N7CP | 120 parts |
| Xylene: Butanol (8:2) | 780 parts |
| (2) Red ink | |
| Aizen Cathilon Red 6BH | 50 parts |
| $Na_2CO_3$ | 50 parts |
| Ethylcellulose N7CP | 120 parts |
| Xylene: Butanol (8:2) | 780 parts |
| (3) Blue ink | |
| Astrazon Blue BGE/X 120% | 50 parts |
| $Na_2CO_3$ | 50 parts |
| Ethylcellulose N7CP | 120 parts |
| Xylene: Butanol (8:2) | 780 parts |

These heat transfer printing sheets were piled so as to contact the printed surface of the sheet with the back side surface of another sheet and the whole was left to stand in a drying container which was kept at the temperature of 40° C. for 100 hours. Almost no contamination toward the back side surface was found.

The above heat transfer printing sheet was piled with an acrylonitrile fiber cloth and the heat transfer printing was carried out by a press which was heated to 190° C. for 75 seconds and as a result a good multicolor heat transfer printed cloth was obtained.

In the heat transfer printing sheet which was obtained by coating the following resins in place of the coating agent for the back side surface as used above, similar results were obtained.

| Composition of resin and coating liquid | | |
|---|---|---|
| Resin used | Solvent used | Resin (%) |
| Polyvinyl alcohol | Water | 7 |
| Methylcellulose | Water | 6 |
| Rosin modified phenol resin | Toluene | 20 |
| Butyral resin | IPA | 10 |
| Polystyrene | Toluene | 15 |
| Polyvinylalcohol: Gelatine | Water | 8(6:2) |

EXAMPLE 17

100 parts of polyvinyl butyral resin were dissolved in 900 parts of a mixed solvent of xylene-ethanol. Then 850 parts of the above obtained solution, 100 parts of dye, Aizen Cathilon Blue 5G and 50 parts of 50% aqueous solution of sodium carbonate were charged into a ball mill and the whole was sufficiently kneaded to obtain a blue ink composition. Further the other surface of the gravure paper in which the back side surface was coated with a resin as described in Example 16 was printed with a desired pattern by using the above obtained ink composition with a gravure-printing method to obtain a heat transfer printing sheet. Almost no contamination of the back side surface was observed when said heat transfer printing sheets were piled and left to stand similarly as in Example 16 and a good result was obtained. The heat transfer printability was also good.

Even if the heat transfer printing sheet was produced in the same manner as above by using the following ink compositions in place of the above ink composition, a similar storage stability was obtained and the heat transfer printing sheet has a good transfer printability.

| Dye | Resin | Solvent | Base |
|---|---|---|---|
| 10 parts | 10 parts (ethylcellulose) | 74 parts xylene: butanol (= 4:1) | 6 parts (NaOH) |
| 10 parts | 10 parts (ethylcellulose) | 70 parts xylene: butanol (= 4:1) | 10 parts ($Na_2CO_3$) |
| 10 parts | 10 parts (ethylcellulose) | 72 parts xylene: butanol (= 4:1) | 5 parts (NaOH) |

EXAMPLE 18

A gravure paper was coated with a liquid consisting of 85 parts of water, 10 parts of polyvinyl alcohol and 5 parts of sodium hydroxide and then was printed by using the three ink compositions as described in Example 16. On the other hand the back side surface of the gravure paper was coated with gelatine similarly as described in Example 16 to obtain a heat transfer printing paper.

When these heat transfer printing sheets were piled as in Example 1, absolutely not offset occurred.

EXAMPLE 19

80 parts of Crystal Violet were dissolved in 1720 parts of water and then 200 parts of 5% sodium hydroxide solution were added to the above obtained solution and after the end of the addition the solution was left to stand. The formed precipitate was separated from the solution by a filtration and sufficiently dried after the precipitate was washed, then, 70 parts of the above dried precipitate and 120 parts of ethylcellulose N7CP were added in a mixed solvent of xylene and butanol (8:2) and the whole was sufficiently kneaded in a ball mill to obtain a violet ink composition. The back side surface coated paper which was prepared in Example 16 was printed by this ink composition to produce a heat transfer printing sheet. As a result, the storage stability and heat transfer printability thereof were good.

EXAMPLE 20

10 parts of gelatin were sufficiently dissolved in 90 parts of water. The obtained solution was coated on the back side surface of a gravure paper by a coating machine and then the coated paper was sufficiently dried. The coating amount was about 1 to 2 g/cm$^2$. 7% aqueous solution of polyvinyl alcohol was coated on the right side surface of the gravure paper by a coating machine and then the coated paper was sufficiently dried. The coating amount was about 1 to 2 g/cm$^2$.

Using the following inks having the following compositions, a multi-color printing was carried out on the right side surface of the above-mentioned printing paper by a gravure printing machine to make a sheet.

TABLE OF INK COMPOSITION

| | |
|---|---|
| (1) Yellow ink | |
| Aizen Cathilon Yellow 3GLH | 50 parts |
| $Na_2CO_3$ | 50 parts |
| Ethylcellulose N7CP | 120 parts |
| Xylene: Butanol (8:2) | 780 parts |
| (2) Red ink | |
| Aizen Cathilon Red 6BH | 50 parts |
| $Na_2CO_3$ | 50 parts |
| Ethylcellulose N7CP | 120 parts |
| Xylene: Butanol (8:2) | 780 parts |
| (3) Blue ink | |
| Astrazon Blue BGE/X 120% | 50 parts |
| $Na_2CO_3$ | 50 parts |
| Ethylcellulose N7CP | 120 parts |
| Xylene: Butanol (8:2) | 780 parts |

A solution which was made by dissolving 3 parts of sodium alginate in 97 parts of water was gravure-coated on the ink-printed surface of the above sheet by a gravure printing machine to obtain a heat transfer printing sheet.

When this heat transfer printing sheet in the wound state was left to stand at the temperature of 30° C. for thirty days a contamination of the back side surface of the base support sheet was almost not found. When a heat transfer printing was carried out on a polyacrylonitrile fiber cloth by using this heat transfer printing sheet with a pressing machine for 75 seconds, a good multicolor printed cloth was obtained.

What we claim is:

1. A heat transfer printing sheet characterized in that a pattern comprising a basic dye having a poor heat transferable property, an alkaline agent having a property of increasing the heat transferable property of the basic dye and a binder is formed on a base support sheet and also a resin film through which the basic dye can be passed when the heat transfer printing is carried out, but can not be passed through when the heat transfer printing is not carried out is formed on the pattern.

2. A process for heat transfer printing which comprises contacting a heat transfer printing sheet having a pattern comprising (1) a basic dye which will not sublime, melt or evaporate at the temperature employed in the heat transfer printing step, (2) from 0.1 to 20 molar equivalent of an alkaline agent per molar equivalent of basic dye and (3) a binder therefor formed on a support sheet, with a material to which said pattern is to be heat transfer printed, and heating said sheet and said material together to transfer said dye to said material.

3. The process of claim 2, wherein the heating step is conducted under pressure.

4. The process of claim 2, wherein the material to which said pattern is to be heat transfer printed is selected from the group consisting of wool, silk, and acetate fibers; and fibers and films of polyamides, polyacrylonitrile and polyvinyl chloride.

5. The process of claim 2, wherein the heating is carried out at a temperature of about 80° to 250° C.

6. The process of claim 3, wherein said pressure is about 50 g/cm$^2$ to 20 kg/cm$^2$.

7. The process of claim 6, wherein the heating under pressure is carried out for about 30 to 90 seconds.

8. The process of claim 2, wherein the amount of alkaline agent in the heat transfer printing sheet is 1 to 10 molar equivalent of alkaline agent per molar equivalent of basic dye.

9. The process of claim 2, wherein a color layer comprising the basic dye, alkaline agent and binder covers the whole surface of the heat transfer printing sheet and a masking member having an open pattern is laminated on said color layer, said material to which the pattern is to be heat transfer printed being brought into contact with said pattern under heat and pressure.

10. The process of claim 2, wherein said heat transfer printing sheet further comprises an overcoat resin coated thereover.

11. The process of claim 2, wherein said support sheet is made of a material which is resistant to the temperature of heat transfer printing.

12. The process of claim 2, wherein said alkaline agent is sodium hydroxide or potassium hydroxide.

13. The process of claim 2, wherein said basic dye is selected from the group consisting of Aizen Cathilon Yellow 3GLH (C.I. 48055), Aizen Cathilon Red 6BH (C.I. 48020), Malachite Green (C.I. 42000), Crystal Violet (C.I. 42555), Aizen Cathilon Blue 5G (C.I. 51005), Aizen Basic Cyanine 6GH (C.I. 42025), Aizen Methylene Blue FZ (C.I. 52015), Aizen Cathilon Brilliant Yellow 5GLH (C.I. Basic yellow 13), Aizen Cathilon Orange RH (C.I. 48040) and Astrazon Pink FG (C.I. 48015).

14. The process of claim 13, wherein said alkaline agent is sodium hydroxide or potassium hydroxide.

15. The process of claim 10, wherein said resin is water-soluble and is selected from the group consisting of polyvinyl alcohol, sodium polyacrylate and polyvinyl pyrrolidone.

16. The process of claim 10, wherein said resin is oil-soluble and is selected from the group consisting of xylene resins, rosin-modified phenol resins, polyvinyl butyral, epoxy resins, polystyrene and petroleum resins.

17. The process of claim 10, wherein said heat transfer printing sheet is coated with a resin film on the backside thereof.

18. In a temporary carrier for use in the dry transfer printing or dyeing process said temporary carrier comprising an inert, heat-resistant base sheet bearing on at least one face thereof a transfer coating the improvement according to which the transfer coating comprises (a) a layer comprising (1) at least one cationic dyestuff which after reacting with an alkalizing agent passes into the vapor state at a temperature of from 160° C. to 210° C. and (2) a binder which upon drying forms a film sufficient to bond the dyestuff to the carrier base, which film is inert to the dyestuff and does not decompose under conditions of transfer, and (b) a layer comprising (1) an alkalizing agent which is capable of reacting with cationic dyestuff present in layer (a) to render said dyestuff vaporizable at a temperature of from 160° C. to 210° C. said agent being selected from the group consisting of an alkali or alkaline earth metal hydroxide and an alkali or alkaline earth metal salt of a weak acid and (2) a binder which is stable to electrolytes, which upon drying forms a film which is inert to dyestuff present during transfer and which does not decompose under conditions to transfer.

19. A temporary carrier according to claim 18, wherein the alkalizing agent is selected from the group consisting of sodium, potassium or lithium hydroxide, sodium, potassium or lithium carbonate, and sodium carboxylate.

20. A temporary carrier according to claim 18, wherein cationic dyestuff present has a molecular weight not in excess of 400.

21. A temporary carrier according to claim 18, wherein layer (a) overlies layer (b).

22. A temporary carrier according to claim 18, wherein the base sheet is parchment paper.

23. A temporary carrier according to claim 18, wherein the binder of layers (a) and (b) is ethyl cellulose.

24. A temporary carrier according to claim 18, wherein the binder of layer (a) is ethyl cellulose and the binder of layer (b) is polyvinyl alcohol.

25. In a method for the dry transfer printing or dyeing or organic material which comprises bringing into contact the surface of the organic material to be dyed or printed and the transfer coated surface of a temporary carrier, subjecting the temporary carrier and organic material to heating at a temperature of about 80° to 250° C. for a time sufficient to effect transfer and separating the organic material and temporary carrier, the improvement according to which the organic material is a material which can be dyed or printed with cationic dyestuff, the temporary carrier is as defined in claim 18, and the time of heating to effect transfer is sufficient to permit reaction between the alkalizing agent and cationic dyestuff and for the thus formed vaporizable to pass from the temporary carrier to the organic material and to penetrate into the said organic material.

* * * * *